US010030348B2

(12) United States Patent
Spang et al.

(10) Patent No.: US 10,030,348 B2
(45) Date of Patent: Jul. 24, 2018

(54) APPARATUS FOR ACTIVATING THE LATERAL FRICTION OF PILE-LIKE LOAD-BEARING MEMBERS

(71) Applicant: DR. SPANG Ingenieurgesellschaft für Bauwesen, Geologie und Umwelttechnik mbH, Witten (DE)

(72) Inventors: Christian Spang, Witten (DE); Gerd Festag, Petershagen (DE); René Schäfer, Dortmund (DE); Sabrina Denne, Witten (DE); Achilles Häring, Esslingen am Neckar (DE); Anna Amchislavski, Dortmund (DE); Bernd-Michael Sulke, Esslingen (DE); Dietmar Mähner, Dülmen (DE); Ansgar Korte, Lingen (DE); Stefan Thünemann, Emsdetten (DE); Ingo Fenneker, Münster (DE)

(73) Assignee: DR. SPRANG Ingenieurgesellschaft für Bauwesen, Geologie und Umwelttechnik mbH, Witten (DE)

( * ) Notice: Subject to any disclaimer, the term of this patent is extended or adjusted under 35 U.S.C. 154(b) by 0 days.

(21) Appl. No.: 15/211,652

(22) Filed: Jul. 15, 2016

(65) Prior Publication Data

US 2017/0016198 A1 Jan. 19, 2017

(30) Foreign Application Priority Data

Jul. 16, 2015 (DE) ..... 10 2015 213 341

(51) Int. Cl.

| | |
|---|---|
| ***E02D 7/20*** | (2006.01) |
| ***E02D 13/00*** | (2006.01) |
| ***E02D 5/22*** | (2006.01) |

(52) U.S. Cl.
CPC ..... *E02D 7/20* (2013.01); *E02D 5/22* (2013.01); *E02D 13/00* (2013.01)

(58) Field of Classification Search
CPC combination set(s) only.
See application file for complete search history.

(56) References Cited

U.S. PATENT DOCUMENTS 5,192,168 A * 3/1993 Massarsch ..... E02D 3/054 405/232
6,869,255 B1 * 3/2005 Beck, III ..... E02D 33/00 405/233

(Continued)

FOREIGN PATENT DOCUMENTS

DE 121382 A1 7/1976
DE 10 2006 007 144 A1 10/2006

(Continued)

*Primary Examiner* — Kyle Armstrong
(74) *Attorney, Agent, or Firm* — Seager, Tufte & Wickhem, LLP

(57) ABSTRACT

The present invention relates to an apparatus for activating the lateral friction of pile-like load-bearing members which are founded in solid rock. The apparatus includes a device which is suitable for reducing a height of the apparatus when the apparatus is subjected to loading by a compressive force. The loading with the compressive force can cause a pile-like load-bearing member to settle in a controlled manner in the ground, the level of settlement being sufficient for activating the lateral friction on the pile-like load-bearing member. The invention also relates to pile-like load-bearing members and building constructions which include such an apparatus as well as to a method for activating the lateral friction of pile-like load-bearing members and a method for erecting a building construction.

15 Claims, 5 Drawing Sheets

(56) References Cited

U.S. PATENT DOCUMENTS

| | | | | |
|---|---|---|---|---|
| 2009/0269146 | A1* | 10/2009 | Miljovski | E02D 5/54 405/233 |
| 2013/0051927 | A1* | 2/2013 | Kruse | E02D 13/10 405/233 |

FOREIGN PATENT DOCUMENTS

| | | | |
|---|---|---|---|
| DE | 102009039570 | A1 | 3/2011 |
| EP | 1930506 | A1 | 6/2008 |
| GB | 2 159 961 | A | 12/1985 |
| KR | 101181543 | B1 * | 9/2012 |

* cited by examiner

APPARATUS FOR ACTIVATING THE LATERAL FRICTION OF PILE-LIKE LOAD-BEARING MEMBERS

CROSS REFERENCES TO RELATED APPLICATIONS

The present application claims priority under 35 U.S.C. § 119 to German Patent Application No. 102015213341.9, filed Jul. 16, 2015, the entirety of which is hereby incorporated by reference.

FIELD OF THE INVENTION

The present invention relates to an apparatus for activating the lateral friction of pile-like load-bearing members, to pile-like load-bearing members and to building constructions which comprise such an apparatus as well as to a method for activating the lateral friction of pile-like load-bearing members and a method for erecting a building construction.

BACKGROUND OF THE INVENTION

In the presence of ground layers which are not capable of bearing high loads, and in the case of building constructions having to meet stringent requirements in respect to stability and serviceability, use is often made of deep foundations in order to dissipate building-construction loads. This is usually done using pile-like load-bearing members which are incorporated in the lower-level, load-bearing layers of soil and introduce the loads from the building construction there with a low level of deformation.

In loose ground, the load is dissipated from the pile-like load-bearing members to the ground surrounding them by way of the two resistance fractions: lateral friction and point bearing pressure. The sum of the resistance here is dependent on the level of settlement of the pile-like load-bearing members. It is usually assumed that the maximum point resistance is mobilized at a level of settlement at the head of the load-bearing members of s/D=0.1 (where s=level of settlement at the head of the load-bearing member, D=diameter of the load-bearing member). Usually relatively small levels of settlement are necessary for the maximum lateral friction.

When the load-bearing member is incorporated in unyielding ground/solid rock, in contrast to loose ground, only very low levels of settlement, if any at all, are necessary in order to mobilize the resistance. Nevertheless, the load is dissipated (theoretically) exclusively via the point bearing pressure/point resistance, since the lateral friction is not mobilized owing to settlement being absent.

In design practice, this results in predominantly only the point resistance being used in the calculations. This means that, by the absence of lateral friction in load-bearing members which are founded in unyielding ground, loads can be transmitted into the ground merely via the point resistance. Load-bearing reserves from the lateral friction thus cannot be utilized. This results in a greater number of piles being required and/or in larger diameters or longer lengths of the piles. On account of the lateral-friction fraction being absent, load-bearing members founded in this way therefore have, in relative terms, only a low load-bearing capacity.

If, however, a certain amount of settlement can be permitted and ensured, then it is possible to mobilize the lateral friction and therefore to increase the overall resistance. If the strength of the bedrock is high to very high, however, it normally cannot be assumed that there is sufficiently high levels of settlement present to activate the lateral friction.

Accordingly, it is an aim of the present invention to provide design measures and methods which allow for a specific minimum level of settlement of the pile-like load-bearing members and thus always ensure the activation of the lateral friction. The amount of settlement here should be definable and foreseeable.

SUMMARY OF THE INVENTION

The present invention relates to an apparatus for activating the lateral friction on pile-like load-bearing members, to a method for activating the lateral friction of pile-like load-bearing members, and to a method for erecting a building construction.

According to a first aspect, an apparatus for activating the lateral friction of pile-like load-bearing members comprises a device which is suitable for reducing a height of the apparatus when the apparatus is subjected to loading by a compressive force. The loading with the compressive force can cause a pile-like load-bearing member to settle in a controlled manner in the ground, said level of settlement being sufficient for activating the lateral friction on the pile-like load-bearing member. The apparatus according to the invention has the advantage that, by allowing for the pile-like load-bearing member to settle, the lateral friction can be activated. In contrast to pile-like load-bearing members which rely purely on point resistance, such load-bearing-member systems are distinguished by greater, specifically brought about mobilizing levels of settlement and, accordingly, by a higher overall resistance. In design terms, this means that, in the case of predetermined building-construction loads, the number of load-bearing members, the necessary diameters and/or the lengths of the load-bearing members can be reduced. This makes it possible to cut back on material (concrete and/or reinforcing material) and, at the same time, to reduce the time required for construction.

In some configurations, the device may be designed such that a substantial reduction in the height of the apparatus begins only once the compressive force acting on the apparatus has exceeded a predetermined limit value. The limit value may be at least 100 kN, preferably at least 150 kN, extremely preferably at least 200 kN and should be capable of being adapted to the building-construction requirements. Moreover, the device may be designed such that, once the reduction in the height of the apparatus has begun by virtue of the predetermined limit value being exceeded, the reduction in the height progresses in a more or less linear relationship with the compressive force acting on the apparatus. This means that the higher the compressive force to which the apparatus is subjected, the greater is the reduction in the height of the apparatus, without any abrupt reduction in the height of the apparatus occurring in the process. This allows for a controlled reduction in the height of the apparatus and thus for desired settlement, and therefore the activation of the lateral friction, to be brought about in a controlled and specific manner. The height of the apparatus here can be reduced by a predetermined maximum value. This means that, once the apparatus has decreased in height by a certain value, no further reduction in the height of the apparatus takes place, even if the compressive force acting on the apparatus increases. The height of the apparatus can be reduced by 0.5 to 5 cm, preferably by 1 to 3 cm, in particular by approximately 2 cm.

In configurations which can be combined with all the previously described configurations, the apparatus may comprise an upper part and a lower part. Moreover, the device may have at least one compression element. The at least one compression element may be arranged between the upper part and the lower part, in particular such that the at least one compression element serves as a spacer in order to form a gap between the upper part and the lower part. Furthermore, at least one aperture for the at least one compression element may be provided on an inner side of the upper part and/or an inner side of the lower part, said aperture having the compression element arranged in it and being dimensioned such that it can also accommodate the compression element once compressed. This means, when the height of the apparatus is reduced by the compressive loading, then the compression element is compressed and changes shape. The apertures may be dimensioned such that they can fully accommodate the compression element once compressed, and therefore the gap between the upper part and the lower part can be fully closed. The at least one compression element can thus be compressed in a controlled manner under predetermined loading by the compressive force. The height of the apparatus can thus decrease continuously to the extent where the gap is closed and the upper part and the lower part come into contact with one another, as a result of which a further reduction in the height of the apparatus is, as far as possible, prevented. The at least one compression element may comprise, for example, an elastomer, preferably a two-component elastomer, in particular an elastomer which comprises polyurethane. The at least one compression element may have a honeycomb and/or accordion structure, which yields in a controlled manner as from a predetermined level of loading by the compressive force. As an alternative, or in addition, the at least one compression element may comprise a structure made up of tubes which can be pressed together in a controlled manner, in particular a structure made up of tubes stacked one above the other. As an alternative, or in addition, the at least one compression element may comprise concrete with plastics material and/or fractions of Styropor. The number, the configuration and the material properties of the compression element or of the compression elements can give rise to a certain resistance characteristic curve of the device, and therefore of the apparatus, and this realizes a defined, foreseeable level of settlement of the pile-like load-bearing member in order to activate the lateral friction. In contrast to this, load-bearing parts, that is to say for example the upper part and the lower part of the apparatus, may consist of high-strength material. It is preferably possible to use concrete or steel, but also very strong plastics materials. There is no resulting reduction, at the foot of the load-bearing member, of the point resistance which is activated once the height of the apparatus has been reduced. The combination of compressible and high-strength components allows here for the same point resistance in comparison with the load-bearing member with no apparatus according to the invention, and therefore the overall resistance of the pile-like load-bearing member can be increased by the amount of the lateral friction. The apparatus may comprise an encircling protective device, which is arranged between the upper part and the lower part in order to prevent foreign matter, dirt and the like from penetrating into the gap. This has the advantage that problematic influences to which the apparatus is exposed by foreign matter, concrete, dirt or the like and which could close the gap, and thus adversely affect the reduction in the height of the apparatus, can be reduced or eliminated. The encircling protective device may comprise a rubber sleeve or a woven-fabric sleeve. As an alternative, the encircling protective device may comprise steel and/or plastics-material elements which slide one inside the other, wherein preferably at least in each case one element is arranged on the upper part and on the lower part. Moreover, the upper part and/or the lower part may have an accommodating space for the protective device, and therefore the protective device does not impede the reduction in the height of the apparatus. The upper part and/or the lower part may have a projection in order to protect the protective device against mechanical stressing. The projection on the upper part and/or on the lower part may be conical. The projection may also be formed by the upper part and/or the lower part itself being conical.

In some configurations, the device may comprise a reservoir with an outlet, in particular wherein the reservoir is filled with a fluid. The device may be configured such that the fluid can be discharged in a controlled manner from the reservoir in order to reduce the height of the apparatus. The fluid may comprise, for example, a Bingham fluid. As an alternative, or in addition, the fluid may comprise an activatable material which sets by being activated, in particular by being activated with a second material component. The fluid may be activated following discharge from the reservoir, it being possible for a base for the pile-like load-bearing member to be formed as a result.

In configurations which can be combined with all the previously described configurations, the apparatus may have a fastening means in order to fasten the apparatus on the pile-like load-bearing member. The fastening means may comprise, for example, a bar, in particular a threaded rod or a reinforcing steel member. The bar may be suitable here, at the same time, for adjusting the apparatus three-dimensionally in relation to the pile-like load-bearing member. The bar may be fitted in a sheath on the apparatus, in particular on the upper part of the apparatus, wherein the sheath may be designed in order to allow movement of the bar in the sheath, and therefore the reduction in the height of the apparatus is not impeded by the bar. It is possible here for an amount of freedom of movement of the bar in the sheath to correspond to an opening width of the gap between the upper part and the lower part. As an alternative, or in addition, a depression may be provided in the lower part, in extension of the bar, and therefore the reduction in the height of the apparatus is not impeded by the bar.

According to a second aspect, a pile-like load-bearing member comprises any one configuration of the apparatus described above. The apparatus here may be fitted at the point of the load-bearing member, wherein the point is that part of the pile-like load-bearing member which advances furthest into the ground. The device of the apparatus may be designed such that there is essentially no reduction in the height of the apparatus caused by the weight of the pile-like load-bearing member, in particular when the pile-like load-bearing member is positioned in the ground.

According to a third aspect, a building construction comprises any one configuration of the apparatus described above and/or any one configuration of the pile-like load-bearing member described above.

According to a fourth aspect, a method for activating the lateral friction of pile-like load-bearing members comprises the following steps: founding a pile-like load-bearing member in an area of ground, applying a compressive force to an apparatus in order to activate the lateral friction on pile-like load-bearing members above a predetermined limit value, and thus reducing a height of the apparatus in order to activate the lateral friction, as a result of which the pile-like load-bearing member is caused to settle in a specific manner, said level of settlement giving rise to activation of the lateral friction on the pile-like load-bearing member. The apparatus here may be fitted at the point of the load-bearing member, wherein the point is that part of the pile-like load-bearing member which advances furthest into the ground, in particular wherein the apparatus is fitted on a reinforcing cage of the load-bearing member. The predetermined limit value may be at least 100 kN, preferably at least 150 kN, extremely preferably at least 200 kN. Once the reduction in the height of the apparatus has begun by virtue of the predetermined limit value of the compressive force applied being exceeded, the reduction in the height may progress in a more or less linear relationship with the compressive force acting on the apparatus. The height of the apparatus may be reduced by a predetermined maximum value. For example, the height of the apparatus may be reduced by 0.5 to 5 cm, preferably by 1 to 3 cm, in particular by approximately 2 cm. The reduction in the height of the apparatus may comprise the reduction in the height of a gap between an upper part and a lower part of the apparatus. The height of the apparatus may be reduced to the extent where the gap is closed and the upper part and the lower part come into contact with one another, as a result of which a further reduction in the height of the apparatus is, as far as possible, prevented. The reduction in the height of the apparatus may be controlled, for example, via a compression element. The reduction in the height of the apparatus may comprise discharging a fluid from the apparatus. Moreover, the method may comprise activation of the discharged fluid following discharge from the apparatus, in particular activation by contact with a second material component, as a result of which the discharged fluid sets. This may result in the formation of a base for the pile-like load-bearing member by the set fluid.

A fifth aspect comprises a method for erecting a building construction, having the following steps: founding a predetermined number of pile-like load-bearing members in an area of ground, wherein an apparatus for activating the lateral friction on the pile-like load-bearing members is fitted at least on some of the pile-like load-bearing members, erecting a building construction on the pile-like load-bearing members, wherein, at a predetermined stage of construction as the building construction is being erected, a compressive force to which the pile-like load-bearing members, and thus the apparatus, are subjected by the building construction exceeds a predetermined limit value, and therefore there is a reduction in the height of the apparatus in order to activate the lateral friction on the pile-like load-bearing members. As a result, the pile-like load-bearing members are caused to settle in a specific manner, and this activates the lateral friction on the pile-like load-bearing member. The apparatus may be fitted at the point of the respective load-bearing member, wherein the point is that part of the pile-like load-bearing member which advances furthest into the ground, in particular the apparatus may be fitted on a reinforcing cage of the load-bearing member. Moreover, the method may comprise the dimensioning of the apparatuses for activating the lateral friction using an expected building-construction mass, load-bearing-member mass and number of load-bearing members as a reference.

Further details and features of the invention will be described with reference to the following figures.

DETAILED DESCRIPTION

The load-bearing behavior of pile-like load-bearing members, e.g. bored piles, is dependent on the external pile resistance which forms in the interaction between soil/rock and the lateral surface of the load-bearing member. Loading is dissipated in the axial direction, on the one hand, via the direct compressive contact on the foot surface of the load-bearing member and, on the other hand, via the lateral friction, that is to say the friction in the joint between the lateral surface of the load-bearing member and the surrounding soil. The lateral friction is activated here by the load-bearing member settling. In particular in firm or very firm ground (rock, stones), it is usually the case that even low levels of settlement suffice in order to mobilize the lateral friction. However, if the pile-like load-bearing members are founded in such firm or very firm ground, even a low level of settlement is in question, as is therefore also the lateral friction which is to be activated.

In order to ensure a defined level of settlement of pile-like load-bearing members, provision is made to arrange in the foot region of the load-bearing members an apparatus 10 which dissipates the loads from the building construction via the point resistance of the load-bearing member. The apparatus 10 here is installed beneath the load-bearing member, between the foot of the latter and the ground, and therefore the height of the apparatus is reduced by the load-bearing member being subjected to loading, and settlement can occur. Defining the strength and/or the resistance to compressive loading of the apparatus allows the levels of settlement to be controlled such that any desired fraction of the lateral friction is mobilized on the pile-like load-bearing members. It is possible here both for full mobilization of the lateral friction to take place and, in dependence on the requirements which have to be met in respect of serviceability, for just some lateral-friction-resistance mobilization to be permitted, the level of settlement being kept specifically low (e.g. by a predetermined limitation on the reduction in the height of the apparatus). In the same way, it is possible for the apparatus to be adapted to the loading which is to be expected (corresponding to the diameter and the length of the load-bearing member and of the building construction provided thereon).

Figure 1:
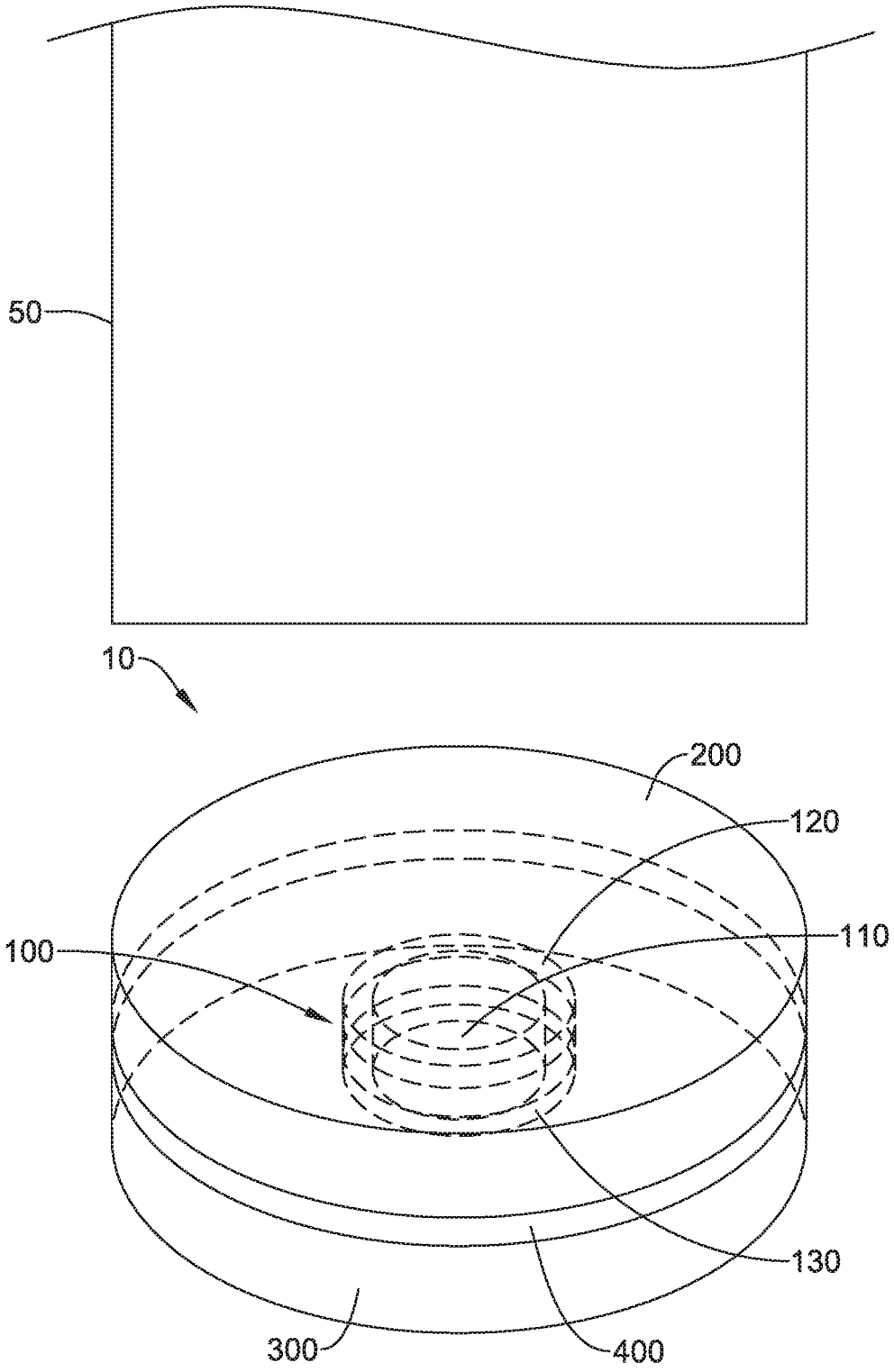
FIG. 1 shows an exemplary embodiment of an apparatus according to the invention.

FIG. 1 shows an exemplary embodiment of an apparatus 10 according to the invention for activating the lateral friction of pile-like load-bearing members. The apparatus comprises a device 100 which is suitable for reducing the height of the apparatus 10 when the apparatus 10 is subjected to loading by a compressive force. The compressive force may act here, for example, on the upper part of the apparatus 10. The loading with the compressive force causes a pile-like load-bearing member 50 to settle in a controlled manner in the ground, said level of settlement being sufficient for activating the lateral friction on the pile-like load-bearing member. In particular when the pile-like load-bearing member enters into hard or very hard ground (rock), the apparatus 10 according to the invention has the advantage that, by allowing for the pile-like load-bearing member to settle, the lateral friction can be activated. In contrast to pile-like load-bearing members which rely purely on point resistance, such load-bearing-member systems are distinguished by greater, specifically brought about mobilizing levels of settlement and, accordingly, by a higher overall resistance. In design terms, this means that, in the case of predetermined building-construction loads, the number of load-bearing members, the necessary diameters and/or the lengths of the load-bearing members can be reduced. This makes it possible to cut back on material (concrete and/or reinforcing material) and, at the same time, to reduce the time required for construction.

A substantial reduction in the height of the apparatus 10 should begin here only once the compressive force acting on the apparatus 10 has exceeded a predetermined limit value. The limit value is, for example, at least 100 kN, preferably at least 150 kN, extremely preferably at least 200 kN. The limit value should be adapted here to the respective use purpose. The limit value therefore varies in dependence on the number and dimensions of the load-bearing members used and on the building construction erected thereon. Moreover, provision is made for the device 100 to be configured such that, once the reduction in the height of the apparatus 10 has begun by virtue of the predetermined limit value being exceeded, the reduction in the height progresses in a more or less linear relationship with the compressive force acting on the apparatus 10. This means that the higher the compressive force to which the apparatus 10 is subjected, the greater the reduction in the height of the apparatus 10, without any abrupt reduction in the height of the apparatus 10 occurring in the process. This allows for a specific and predetermined reduction in the height of the apparatus 10 and thus for desired settlement, and therefore the activation of the lateral friction, to be brought about in a controlled and specific manner. The height of the apparatus 10 here can be reduced by a predetermined maximum value. This means that, once the apparatus 10 has decreased in height by a certain value, no further reduction in the height of the apparatus takes place, even if the compressive force acting on the apparatus increases. It is possible, for example, for the height of the apparatus to be reduced by 0.5 to 5 cm, preferably by 1 to 3 cm, in particular by approximately 2 cm.

The example of the apparatus 10 from FIG. 1 has an upper part 200 and a lower part 300. A compression element 110 is arranged between the upper part 200 and the lower part 300, wherein the compression element 110 serves as a spacer in order to form a gap 400 between the upper part 200 and the lower part 300. Furthermore, a respective aperture 120, 130 for the at least one compression element 110 is provided on the inner side of the upper part 200 and on the inner side of the lower part 300 (as an alternative, it is possible for just a single aperture to be provided either in the upper part 200 or in the lower part 300), said aperture having the compression element 110 arranged in it. The apertures 120, 130, which can be seen particularly clearly in the exploded illustration of FIG. 2, are dimensioned such that they can also accommodate the compression element 110 once compressed. This means that, when the height of the apparatus 10 is reduced by the compressive loading, then the compression element 110 is compressed and changes shape. The apertures 120, 130 are dimensioned such that they can fully accommodate the compression element 110 once compressed, and therefore the gap 400 between the upper part 200 and the lower part 300 can be fully closed. The compression element 110 can be compressed in a controlled manner under predetermined loading by the compressive force. It is thus possible for the height of the apparatus 10 to decrease continuously to the extent where the gap 400 is closed and the upper part 200 and the lower part 300 come into contact with one another, as a result of which a further reduction in the height of the apparatus 10 is, as far as possible, prevented.

The compression element 110 may comprise, for example, an elastomer, preferably a two-component elastomer, in particular an elastomer which comprises polyurethane. It is possible, for example, to use a two-component polyurethane-based casting resin. Such casting resins can be used to produce any desired dimensions and can therefore produce heights and cross sections appropriate for the use purpose. As an alternative to the elastomer, or in addition, it is possible for the at least one compression element 110 to comprise concrete with plastics material and/or fractions of Styropor. In particular when selecting the material for the compression element 110, it should be ensured that the material has a certain initial strength to withstand the weight of the pile-like load-bearing member (e.g. fresh concrete prior to setting) without any greater levels of deformation/compression. The desired compression and, consequently, reduction in the height of the apparatus 10 must not occur during installation of the pile; rather, it should take place during the first loading phase (ideally during the first instances of loading which occur during construction). During the first loading phase (e.g. increasing weight of the building construction as it is erected), the compression element 110 should press together in a controlled manner in the apparatus 10 until the gap 400 between the upper part 200 and the lower part 300 is closed. Once the gap 400 has closed, the force/deformation behavior (that is to say the compression behavior) of the compression element 110 is more or less insignificant. This means that, ideally, the force/deformation curve of the material used has a high initial strength, followed by a linear, controlled level of strength up to the gap 400 being closed, and then any desired, more or less plastic behavior.

Figure 2A:
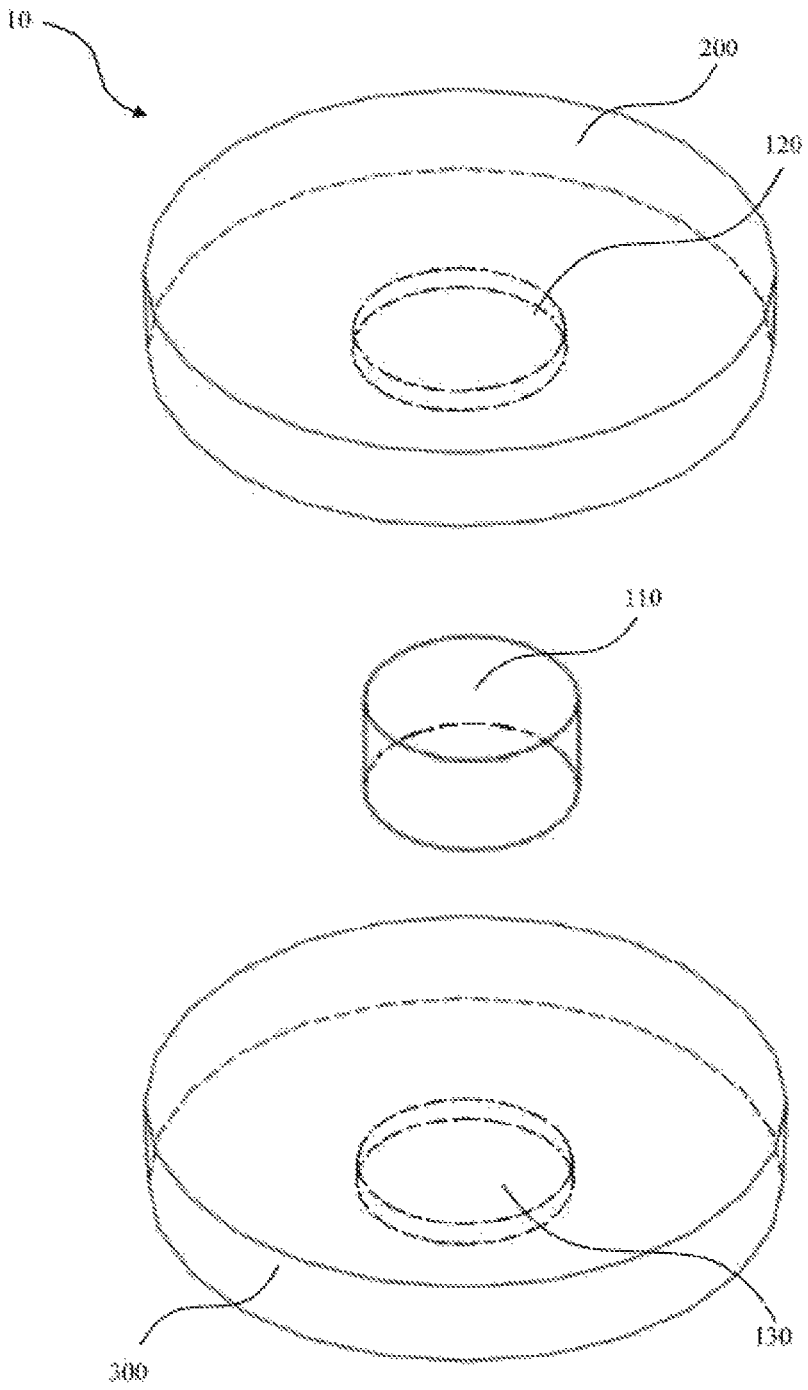
FIG. 2A shows an exploded view of the apparatus according to the invention in the exemplary embodiment from FIG. 1.
Figure 2B:
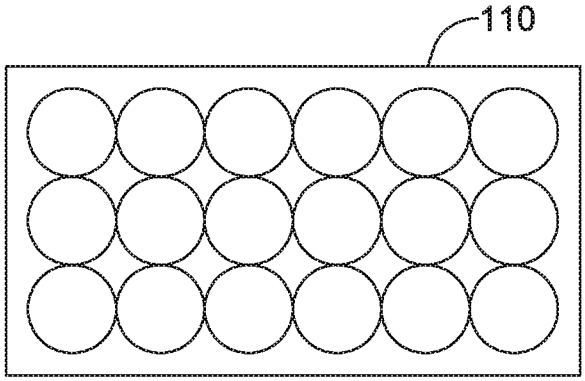
FIG. 2B shows a side view of an exemplary compression element according to the invention.
Figure 3A:
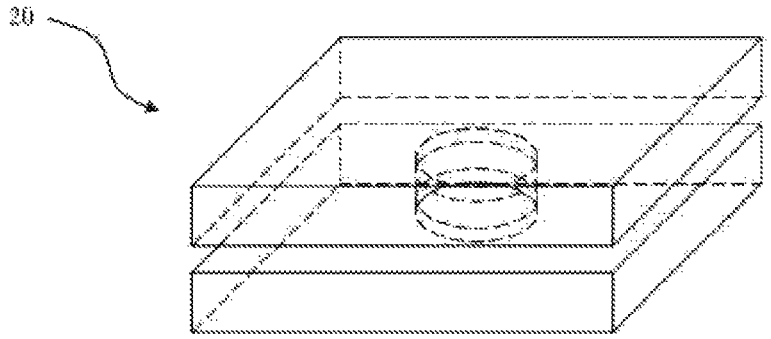
FIGS. 3A-3D show alternative exemplary embodiments of the apparatus according to the invention.
Figure 3B:
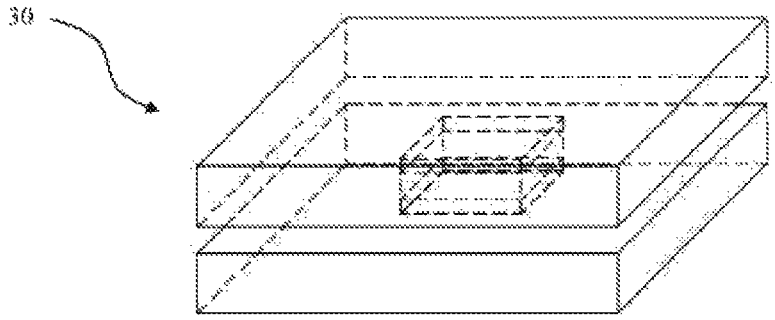
Figure 3C:
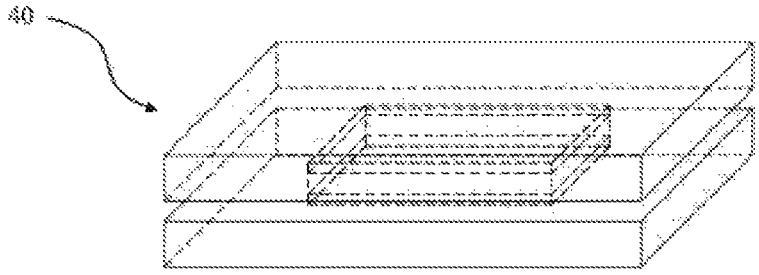
Figure 3D:
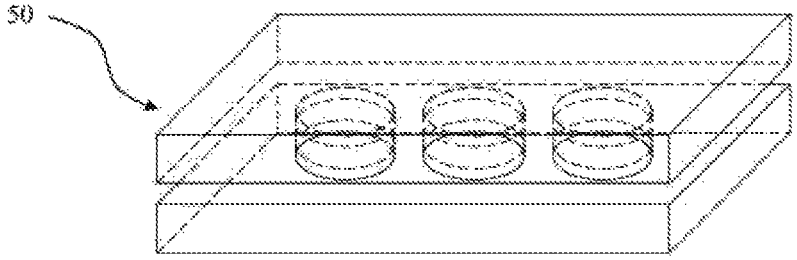
Figure 4:
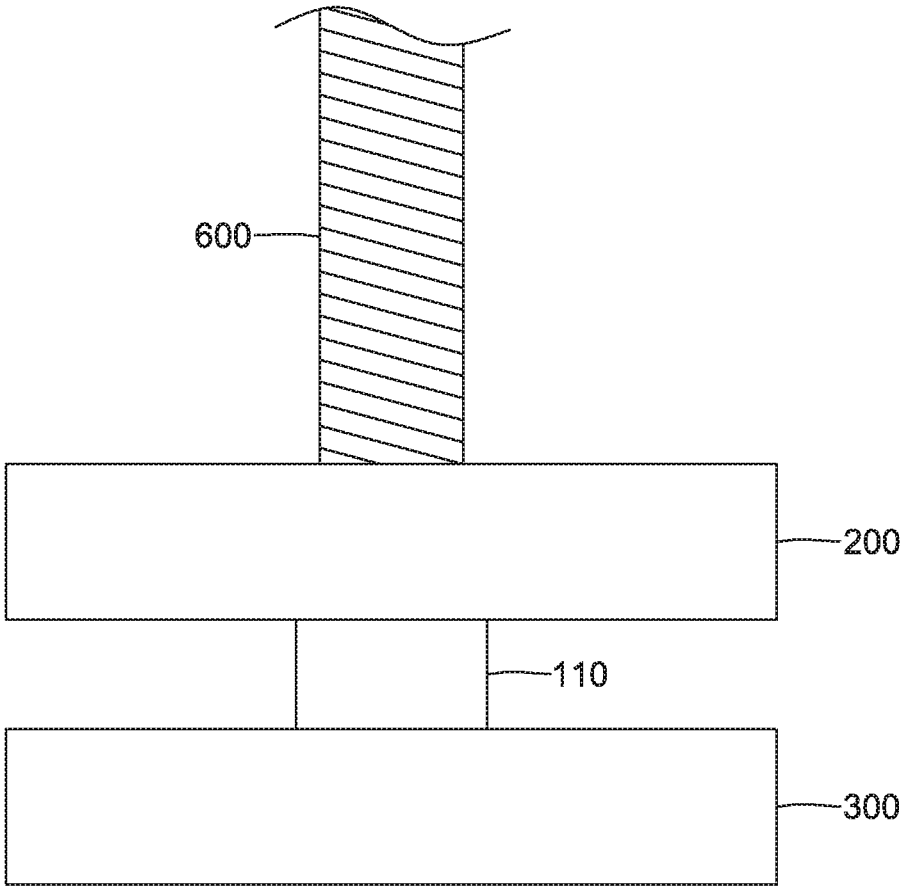
FIG. 4 shows a side view of a further exemplary apparatus according to the invention.

In addition to the solid body indicated in FIG. 2A, the at least one compression element 110 may also have a honeycomb and/or accordion structure which yields in a controlled manner as from a predetermined level of loading by the compressive force. As an alternative, or in addition, the at least one compression element may comprise a structure made up of tubes which can be pressed together in a controlled manner, in particular a structure made up of tubes stacked one above the other (FIG. 2B). The number, the configuration and the material properties of the compression element 110 or of the compression elements can give rise to a defined, foreseeable level of settlement of the pile-like load-bearing member in order to activate the lateral friction. In contrast to this, load-bearing parts, that is to say for example the upper part 200 and the lower part 300 of the apparatus 10, may consist of high-strength material. It is possible, for example, to use concrete or steel, but also very strong plastics materials. Using high-strength materials does not result in a reduction, at the foot of the load-bearing member, in the point resistance which is activated once the height of the apparatus 10 has been reduced. The combination of compressible and high-strength components allows here for the same point resistance in comparison with the load-bearing member with no apparatus 10 according to the invention, and therefore the overall resistance of the pile-like load-bearing member can be increased by the amount of the lateral friction.

FIGS. 3A-3D show further exemplary embodiments of the apparatus 10 according to the invention. As can be seen in FIGS. 1, 2, and 3A-3D, the apparatus may be of round/circular, rectangular or square basic shape. The shape of the compression element 110 and of the apertures 120, 130 can be adapted correspondingly. The number of compression elements 110 in the apparatus can be varied as desired, in dependence on requirements. FIGS. 3A-3D show exemplary embodiments having one and three compression elements 110. It is also possible, however, to have any other number and arrangement of compression elements 110 in the apparatus 10, from one compression element to more than 10, more than 20, more than 50 or more than 100 compression elements.

The apparatus 10, moreover, may comprise an encircling protective device (not illustrated in the figures). The protective device is arranged between the upper part 200 and the lower part 300 in order to prevent foreign matter, dirt and the like from penetrating into the gap 400. This has the advantage that problematic influences to which the apparatus 10 is exposed by foreign matter, concrete, dirt or the like and which could close the gap 400, and thus adversely affect the reduction in the height of the apparatus 10, are reduced or eliminated. The encircling protective device may have, for example, a rubber sleeve or a woven-fabric sleeve. As an alternative, the encircling protective device may comprise steel and/or plastics-material elements which slide one inside the other, wherein preferably at least in each case one element is arranged on the upper part 200 and on the lower part 300. Moreover, the upper part 200 and/or the lower part 300 should then have an accommodating space for the protective device, and therefore the protective device does not impede the reduction in the height of the apparatus 10.

Furthermore, the upper part 200 and/or the lower part 300 may have a projection in order to protect the protective device against mechanical stressing when the apparatus is advanced into the ground. The projection on the upper part 200 and/or on the lower part 300 may be, for example, conical. The projection may also be formed by the upper part 200 and/or the lower part 300 itself being conical.

As an alternative, or in addition, to the compression elements 110 illustrated in FIGS. 1, 2, and 3A-3D, the device 100 may comprise a reservoir with an outlet, wherein the reservoir is filled with a fluid. The device may be configured such that the fluid can be discharged in a controlled manner from the reservoir in order to reduce the height of the apparatus 10. The fluid may comprise, for example, a Bingham fluid. As an alternative, or in addition, the fluid may comprise an activatable material which sets by being activated, in particular by being activated with a second material component (which, for example, is also accommodated in the apparatus or is fed by some other route). The fluid may be activated following discharge from the reservoir, for example by such a second material component or in some other way (for example thermal radiation or some other type of radiation), a base for the pile-like load-bearing member being formed as a result.

All the previously described embodiments of the apparatus 10 may have a fastening means 600 in order to fasten the apparatus on the pile-like load-bearing member (illustrated in FIG. 6). The fastening means 600 may comprise, for example, a bar, in particular a threaded rod, as illustrated in FIG. 6, or a reinforcing steel member. At the same time, the bar may also be suitable for adjusting the apparatus 10 three-dimensionally in relation to the pile-like load-bearing member. The bar may be fitted, for example, in a sheath on the apparatus 10, in particular on the upper part 200 of the apparatus 10, wherein the sheath may be designed in order to allow movement of the bar in the sheath, and therefore the reduction in the height of the apparatus 10 is not impeded by the bar. It is possible here for the amount of freedom of movement of the bar in the sheath to be adapted to correspond to the opening width of the gap 400 between the upper part 200 and the lower part 300. As an alternative, or in addition, a depression may be provided in the lower part 300, in extension of the bar, and therefore the reduction in the height of the apparatus 10 is not impeded by the bar.

The previously described apparatus 10 is used, in particular, in combination with pile-like load-bearing members. The apparatus 10 here is fitted at the point of the load-bearing member, wherein the point is that part of the pile-like load-bearing member which advances furthest into the ground. The device 100 of the apparatus 10 may be designed such that there is essentially no reduction in the height of the apparatus 10 caused by the weight of the pile-like load-bearing member on which said apparatus is fitted, in particular when the pile-like load-bearing member is positioned in the ground. The apparatuses 10 described, and also the pile-like load-bearing members having such apparatuses, can be used for all kinds of building construction.

A method which results in the activation of the lateral friction on pile-like load-bearing members will be described hereinbelow. In particular this method should be used by way of example for a pile-like load-bearing member in the form of a bored pile, in particular in conjunction with a building construction being erected on such piles. This method can make use, for example, of the apparatus 10 described above. In a preparatory step, the apparatus 10 should be dimensioned in accordance with its use purpose (construction plan) and, accordingly, produced in a sufficient quantity. The apparatuses 10 may be provided for each, or only for some, of the piles planned for the building construction. The finished apparatus 10 is installed at the lower end of a reinforcing cage of a bored pile. Irrespective of this, the pile-boring operation, that is to say the production of the lined borehole for the subsequent bored pile, takes place into the bedrock of the ground. The reinforcing cage with apparatus 10 fitted is then placed in the pile borehole. The apparatus 10 here should stand as far as possible with its entire surface area resting on the base of the pile borehole in the rock. Following placement, the apparatus 10 is subjected to the loading of the weight of the reinforcing cage. The height of the apparatus 10 should not yet decrease in this case. This is followed by the bored pile being concreted. The apparatus 10 here in the first instance is subjected to loading by the weight of the fresh concrete and should not yet decrease in height here either. This is followed by the pile concrete setting. Since there is no significant change in the weight to which the apparatus 10 is subjected here, there should not be any reduction in the height in this step either. However, the setting of the concrete also results in the apparatus 10, including the compression element 110, being heated. The compression element 110 here should exhibit no (or at least only small amounts of) creep deformation. The loading to which each pile, and the respective apparatus 10, is subjected increases as a result of the shell structure rising slowly upward (on the piles). The loads from the shell structure give rise to the necessary compressive force which is sufficient to trigger the reduction in the height of the apparatus 10 and thus to cause the pile to settle. This activates the lateral friction over the entire length of the pile shank, that is to say both in the layers of (solid) rock and in the layers of loose ground. Any further shell construction, development work and loading with live loads has no further effect as soon as the maximum reduction in the height of the apparatus 10 is reached. All the loads to which the apparatus 10 is subjected are transmitted via the high-strength load-bearing part of the apparatus 10 and no more loads are transmitted, in design terms, by the device 100. It is therefore also the case that the material behavior of the compression element 110 has no further role to play. The loads are then transmitted to the ground entirely by way of the pile, in classic fashion, via lateral friction and point resistance.

The activation of the lateral friction on the pile-like load-bearing members thus takes place above a predetermined limit value for a compressive loading (by way of the pile itself and the building construction being erected thereon), by the reduction in the height of the apparatus 10 for activating the lateral friction, as a result of which the pile-like load-bearing members are made to settle in a specific manner, said level of settlement, in turn, giving rise to activation of the lateral friction. For this purpose, the apparatus 10 is fitted at the point of the load-bearing member, wherein the point is that part of the pile-like load-bearing member which advances furthest into the ground. Depending on the building construction and the size or number of the load-bearing members used, the predetermined limit value may be, for example, at least 100 kN, preferably at least 150 kN, extremely preferably at least 200 kN. Once the reduction in the height of the apparatus 10 has begun by virtue of the predetermined limit value of the compressive force applied being exceeded, the reduction in the height progresses in a more or less linear relationship with the compressive force acting on the apparatus 10. The height of the apparatus 10 is reduced by a predetermined maximum value as construction progresses. For example, the height of the apparatus 10 can be reduced by 0.5 to 5 cm, preferably by 1 to 3 cm, in particular by approximately 2 cm. In respect of the exemplary embodiments of the apparatus 10 in FIGS. 1, 2, and 3A-3D, the height of the apparatus 10 is reduced to the extent where the gap 400 is closed and the upper part 200 and the lower part 300 come into contact with one another, as a result of which a further reduction in the height of the apparatus 10 is, as far as possible, prevented. The reduction in the height of the apparatus 10 here is controlled via the compression element 110. As an alternative, or in addition, the reduction in the height of the apparatus 10 may comprise, as described above, discharging a fluid from the apparatus. Moreover, the method may comprise activation of the discharged fluid following discharge from the apparatus, in particular activation by contact with a second material component, as a result of which the discharged fluid sets. This can result in the formation, in the ground, of a base for the pile-like load-bearing member by the set fluid.

Although the present invention has been described above and is defined in the accompanying claims, it should be understood that the invention, as an alternative, can also be defined in accordance with the following embodiments:

1. An apparatus (10) for activating the lateral friction of pile-like load-bearing members, wherein the apparatus (10) comprises a device (100) which is suitable for reducing a height of the apparatus (10) when the apparatus (10) is subjected to loading by a compressive force, as a result of which it is possible to cause a pile-like load-bearing member to settle in a controlled manner in the ground, said level of settlement being sufficient for activating the lateral friction.
2. The apparatus according to embodiment 1, wherein the device (100) is designed such that a substantial reduction in the height of the apparatus (10) begins only once the compressive force acting on the apparatus (10) has exceeded a predetermined limit value.
3. The apparatus according to embodiment 2, wherein the limit value is at least 100 kN, preferably at least 150 kN, extremely preferably at least 200 kN.
4. The apparatus according to embodiment 2 or embodiment 3, wherein the device (100) is designed such that, once the reduction in the height of the apparatus (10) has begun by virtue of the predetermined limit value being exceeded, the reduction in the height progresses in a more or less linear relationship with the compressive force acting on the apparatus (10).
5. The apparatus according to any one of the preceding embodiments, wherein the height of the apparatus (10) can be reduced by a predetermined maximum value.
6. The apparatus according to any one of the preceding embodiments, wherein the height of the apparatus (10) can be reduced by 0.5 to 5 cm, preferably by 1 to 3 cm, in particular by approximately 2 cm.
7. The apparatus according to any one of the preceding embodiments, wherein the apparatus (10) comprises an upper part (200) and a lower part (300).
8. The apparatus according to any one of the preceding embodiments, wherein the device (100) comprises at least one compression element (110).
9. The apparatus according to embodiment 8, wherein the at least one compression element (110) is arranged between the upper part (200) and the lower part (300), in particular such that the at least one compression element (110) serves as a spacer in order to form a gap (400) between the upper part (200) and the lower part (300).
10. The apparatus according to embodiment 8 or embodiment 9, wherein at least one aperture (120, 130) for the at least one compression element (110) is provided on an inner side of the upper part (200) and/or an inner side of the lower part (300), said aperture having the compression element (110) arranged in it and being dimensioned such that it can also accommodate the compression element (110) once compressed.
11. The apparatus according to embodiment 10, wherein the at least one compression element (110) is compressed in a controlled manner under predetermined loading by the compressive force and the height of the apparatus (10) thus decreases to the extent where the gap (400) is closed and the upper part (200) and the lower part (300) come into contact with one another, as a result of which a further reduction in the height of the apparatus (10) is, as far as possible, prevented.
12. The apparatus according to any one of embodiments 8 to 11, wherein the at least one compression element (110) comprises an elastomer, preferably a two-component elastomer, in particular an elastomer which comprises polyurethane.
13. The apparatus according to any one of embodiments 8 to 12, wherein the at least one compression element (110) has a honeycomb and/or accordion structure which yields in a controlled manner as from a predetermined level of loading by the compressive force.
14. The apparatus according to any one of embodiments 8 to 11, wherein the at least one compression element (110) comprises a structure made up of tubes which can be pressed together in a controlled manner, in particular a structure made up of tubes stacked one above the other.
15. The apparatus according to any one of embodiments 8 to 11, wherein the at least one compression element (110) comprises concrete with plastics material and/or fractions of Styropor.

16. The apparatus according to any one of embodiments 9 to 15, wherein the apparatus (10) comprises an encircling protective device, which is arranged between the upper part (200) and the lower part (300) in order to prevent foreign matter, dirt and the like from penetrating into the gap (400).
17. The apparatus according to embodiment 16, wherein the encircling protective device comprises a rubber sleeve or a woven-fabric sleeve.
18. The apparatus according to embodiment 16, wherein the encircling protective device comprises steel and/or plastics-material elements which slide one inside the other, wherein preferably at least in each case one element is arranged on the upper part (200) and on the lower part (300).
19. The apparatus according to any one of embodiments 16 to 18, wherein the upper part (200) and/or the lower part (300) have/has an accommodating space for the protective device, and therefore the protective device does not impede the reduction in the height of the apparatus (10).
20. The apparatus according to any one of embodiments 16 to 19, wherein the upper part (200) and/or the lower part (300) have/has a projection in order to protect the protective device against mechanical stressing.
21. The apparatus according to embodiment 20, wherein the projection on the upper part (200) and/or on the lower part (300) is conical, or wherein the projection is formed by the upper part (200) and/or the lower part (300) itself being conical.
22. The apparatus according to any one of embodiments 1 to 6, wherein the device (100) comprises a reservoir with an outlet, in particular wherein the reservoir is filled with a fluid.
23. The apparatus according to embodiment 22, wherein the fluid can be discharged in a controlled manner from the reservoir in order to reduce the height of the apparatus (10).
24. The apparatus according to embodiment 22 or embodiment 23, wherein the fluid comprises a Bingham fluid.
25. The apparatus according to any one of embodiments 22 to 24, wherein the fluid comprises an activatable material which sets by being activated, in particular by being activated with a second material component.
26. The apparatus according to embodiment 25, wherein the fluid is activated following discharge from the reservoir, a base for the pile-like load-bearing member being formed as a result.
27. The apparatus according to any one of the preceding embodiments, wherein the apparatus (10) comprises a fastening means in order to fasten the apparatus on the pile-like load-bearing member.
28. The apparatus according to embodiment 27, wherein the fastening means comprises a bar, in particular a threaded rod or a reinforcing steel member.
29. The apparatus according to embodiment 28, wherein the bar is suitable, at the same time, for adjusting the apparatus (10) three-dimensionally in relation to the pile-like load-bearing member.
30. The apparatus according to embodiment 28 or embodiment 29, wherein the bar is fitted in a sheath on the apparatus (10), in particular on the upper part (200) of the apparatus, and wherein the sheath is designed in order to allow movement of the bar in the sheath, and therefore the reduction in the height of the apparatus (10) is not impeded by the bar.
31. The apparatus according to embodiment 28, wherein an amount of freedom of movement of the bar in the sheath corresponds to an opening width of the gap (400) between the upper part (200) and the lower part (300).
32. The apparatus according to any one of embodiments 28 to 31, wherein a depression is provided in the lower part (300), in extension of the bar, and therefore the reduction in the height of the apparatus (10) is not impeded by the bar.
33. A pile-like load-bearing member which comprises an apparatus (10) according to any one of the preceding embodiments.
34. The pile-like load-bearing member according to embodiment 33, wherein the apparatus (10) is fitted at the point of the load-bearing member, wherein the point is that part of the pile-like load-bearing member which advances furthest into the ground.
35. The pile-like load-bearing member according to embodiment 33 or embodiment 34, wherein the device (100) of the apparatus (10) is designed such that there is essentially no reduction in the height of the apparatus (10) caused by the weight of the pile-like load-bearing member, in particular when the pile-like load-bearing member is positioned in the ground.
36. A building construction which comprises an apparatus according to any one of embodiments 1 to 32 and/or a pile-like load-bearing member according to any one of embodiments 33 to 35.
37. A method for activating the lateral friction of pile-like load-bearing members, comprising:
    founding a pile-like load-bearing member in an area of ground;
    applying a compressive force to an apparatus (10) in order to activate the lateral friction on pile-like load-bearing members above a predetermined limit value; and thus
    reducing a height of the apparatus in order to activate the lateral friction, as a result of which it is possible to cause the pile-like load-bearing member to settle in a specific manner, said level of settlement giving rise to activation of the lateral friction on the pile-like load-bearing member.
38. The method according to embodiment 37, wherein the apparatus (10) is fitted at the point of the load-bearing member, wherein the point is that part of the pile-like load-bearing member which advances furthest into the ground, in particular wherein the apparatus (10) is fitted on a reinforcing cage of the load-bearing member.
39. The method according to embodiment 37 or embodiment 38, wherein the predetermined limit value is at least 100 kN, preferably at least 150 kN, extremely preferably at least 200 kN.
40. The method according to any one of embodiments 37 to 39, wherein, once the reduction in the height of the apparatus (10) has begun by virtue of the predetermined limit value of the compressive force applied being exceeded, the reduction in the height progresses in a more or less linear relationship with the compressive force acting on the apparatus (10).
41. The method according to any one of embodiments 37 to 40, wherein the height of the apparatus (10) can be reduced by a predetermined maximum value, in particular wherein the height of the apparatus (10) can be reduced by 0.5 to 5 cm, preferably by 1 to 3 cm, in particular by approximately 2 cm.
42. The method according to any one of embodiments 37 to 41, wherein the reduction in the height of the apparatus (10) comprises the reduction in the height of a gap (400) between an upper part (200) and a lower part (300) of the apparatus (10).

43. The method according to embodiment 42, wherein the height of the apparatus (10) is reduced to the extent where the gap (400) is closed and the upper part (200) and the lower part (300) come into contact with one another, as a result of which a further reduction in the height of the apparatus (10) is, as far as possible, prevented.

44. The method according to any one of embodiments 37 to 43, wherein the reduction in the height of the apparatus (10) is controlled via a compression element (110).

45. The method according to any one of embodiments 37 to 44, wherein the reduction in the height of the apparatus comprises discharging a fluid from the apparatus.

46. The method according to embodiment 45, comprising activation of the discharged fluid following discharge from the apparatus, in particular activation by contact with a second material component, as a result of which the discharged fluid sets, and thus formation of a base for the pile-like load-bearing member by the set fluid.

47. A method for erecting a building construction, comprising:

founding a predetermined number of pile-like load-bearing members in an area of ground, wherein an apparatus (10) for activating the lateral friction on the pile-like load-bearing members is fitted at least on some of the pile-like load-bearing members;

erecting a building construction on the pile-like load-bearing members;

wherein, at a predetermined stage of construction as the building construction is being erected, a compressive force to which the pile-like load-bearing members are subjected by the building construction exceeds a predetermined limit value, there is a reduction in the height of the apparatus (10) in order to activate the lateral friction on the pile-like load-bearing members, as a result of which the pile-like load-bearing members are caused to settle in a specific manner, and this activates the lateral friction on the pile-like load-bearing member.

48. The method according to embodiment 47, wherein the apparatus (10) is fitted at the point of the respective load-bearing member, wherein the point is that part of the pile-like load-bearing member which advances furthest into the ground, in particular wherein the apparatus (10) is fitted on a reinforcing cage of the load-bearing member.

49. The method according to embodiment 47 or embodiment 48, comprising dimensioning of the apparatuses (10) for activating the lateral friction using an expected building-construction mass, load-bearing-member mass and number of load-bearing members as a reference.

What is claimed is:

1. An apparatus for increasing the skin friction of a pile load-bearing member in a deep foundation when the apparatus is disposed in the ground beneath the pile load-bearing member and a building construction load is applied to the pile load-bearing member, the apparatus comprising:

an upper part;

a lower part; and a compressible device that reduces a height of the apparatus when the apparatus is subjected to loading by a compressive force from the building construction, as a result of which the pile load-bearing member settles in a controlled manner in the ground, said level of settlement being sufficient for increasing the skin friction;

wherein the compressible device comprises at least one compression element arranged between the upper part and the lower part such that the at least one compression element serves as a spacer in order to form a gap between the upper part and the lower part, wherein the at least one compression element changes shape as the height of the apparatus is reduced.

2. The apparatus as claimed in claim 1, wherein the compressible device is configured such that a substantial reduction in the height of the apparatus begins only once the compressive force acting on the apparatus has exceeded a predetermined limit value.

3. The apparatus as claimed in claim 2, wherein the limit value is at least 100 kN, at least 150 kN, or at least 200 kN.

4. The apparatus as claimed in claim 2, wherein the compressible device is configured such that, once the reduction in the height of the apparatus has begun by virtue of the predetermined limit value being exceeded, the reduction in the height progresses in a linear relationship with the compressive force acting on the apparatus.

5. The apparatus as claimed in claim 1, wherein the height of the apparatus can be reduced by a predetermined maximum value, such as by 0.5 to 5 cm, by 1 to 3 cm, or by approximately 2 cm.

6. The apparatus as claimed in claim 1, wherein at least one aperture for the at least one compression element is provided on an inner side of the upper part and/or an inner side of the lower part, said aperture having the compression element arranged in it and being dimensioned such that it can also accommodate the compression element once compressed.

7. The apparatus as claimed in claim 1, wherein the at least one compression element comprises a structure made up of tubes which can be pressed together in a controlled manner, the structure made up of tubes stacked one above the other.

8. The apparatus as claimed in claim 1, wherein the at least one compression element comprises an elastomer, such as a two-component elastomer, an elastomer which comprises polyurethane, and/or wherein the at least one compression element comprises concrete with plastics material.

9. The apparatus as claimed in claim 1, wherein the apparatus further comprises a fastening means configured to fasten the apparatus on the pile load-bearing member, wherein the fastening means comprises a bar, a threaded rod or a reinforcing steel member.

10. The apparatus as claimed in claim 1, wherein the apparatus is part of a pile load-bearing member.

11. The apparatus as claimed in claim 10, wherein the apparatus is fitted at a point of the load-bearing member which advances furthest into the ground.

12. The apparatus as claimed in claim 10, wherein there is no reduction in the height of the apparatus caused by the weight of the pile load-bearing member when the pile load-bearing member is positioned in the ground.

13. The apparatus as claimed in claim 1, wherein the apparatus is part of a building construction.

14. A method for increasing the skin friction of pile load-bearing members inserted into an area of ground, comprising:

inserting an apparatus into the ground, the apparatus including an upper part, a lower part, and at least one compression element disposed between the upper and lower parts such that the at least one compression element serves as a spacer in order to form a gap between the upper part and the lower part, wherein the at least one compression element changes shape as a height of the apparatus is reduced;

placing a pile load-bearing member on top of the apparatus;

applying a compressive force to the pile load-bearing member by erecting a building construction on the pile load-bearing member, and thereby to the apparatus thereby increasing the skin friction on the pile load-bearing members above a predetermined limit value; whereby reducing the height of the apparatus increases the skin friction, as a result of which the pile load-bearing member is caused to settle in a specific manner, said level of settlement giving rise to an increase of the skin friction on the pile load-bearing member.

15. A method for erecting a building construction with a deep foundation extending into the ground, comprising:

producing a plurality of boreholes in the ground;

placing a plurality of pile load-bearing members into the plurality of boreholes, wherein at least some of the pile load-bearing members are placed on top of an apparatus, the apparatus including an upper part, a lower part, and at least one compression element disposed between the upper and lower parts such that the at least one compression element serves as a spacer in order to form a gap between the upper part and the lower part, wherein the at least one compression element changes shape as a height of the apparatus is reduced, wherein each apparatus increases the skin friction on the pile load-bearing member disposed above it;

erecting a building construction on the pile load-bearing members;

wherein, at a predetermined stage of construction as the building construction is being erected, a compressive force to which the pile load-bearing members are subjected by the building construction exceeds a predetermined limit value, there is a reduction in the height of the apparatus that increases the skin friction on the pile load-bearing members, as a result of which the pile load-bearing members are caused to settle in a specific manner, thereby activating the skin friction on the pile load-bearing member.

* * * * *